US011085729B2

(12) United States Patent
Ozanne et al.

(10) Patent No.: US 11,085,729 B2
(45) Date of Patent: Aug. 10, 2021

(54) ARCHERY BOW STRING STOP

(71) Applicant: MCP IP, LLC, Sparta, WI (US)

(72) Inventors: Jeffrey A. Ozanne, La Crosse, WI (US); Mark J. Hayes, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/811,892

(22) Filed: Mar. 6, 2020

(65) Prior Publication Data

US 2020/0284548 A1 Sep. 10, 2020

Related U.S. Application Data

(60) Provisional application No. 62/815,970, filed on Mar. 8, 2019.

(51) Int. Cl.
*F41B 5/14* (2006.01)

(52) U.S. Cl.
CPC ..... *F41B 5/1407* (2013.01)

(58) Field of Classification Search
CPC ..... F41B 5/10; F41B 5/123; F41B 5/1407; F41B 5/1426
See application file for complete search history.

(56) References Cited

U.S. PATENT DOCUMENTS 1,044,412 A 11/1912 Newton
1,211,480 A 1/1917 Newton
1,232,000 A 7/1917 Chase
1,354,469 A 10/1920 Joseph
1,918,652 A 7/1933 Marbach
4,054,121 A 10/1977 Hoyt, Jr.
4,061,125 A 12/1977 Trotter
4,377,152 A 3/1983 Saunders
4,461,267 A 7/1984 Simonds et al.
4,628,892 A 12/1986 Windedahl et al.
5,002,035 A 3/1991 Brooks
5,010,622 A 4/1991 Morita
5,016,602 A 5/1991 Mizek
5,178,122 A 1/1993 Simonds
5,320,085 A 6/1994 Hanneman
5,392,757 A 2/1995 Head et al.
5,452,704 A 9/1995 Winebarger
5,531,211 A 7/1996 Wilfong, Jr.
5,535,731 A 7/1996 Webster
5,649,527 A 7/1997 Olsen et al.
5,720,269 A 2/1998 Saunders
5,975,070 A 11/1999 Sands
5,992,403 A 11/1999 Slates
6,092,516 A 7/2000 Martin et al.
6,298,842 B1 10/2001 Sims
6,382,201 B1 5/2002 McPherson et al.
6,425,385 B1 7/2002 Gallops, Jr.
6,634,348 B2 10/2003 Gallops, Jr.
(Continued)

*Primary Examiner* — John A Ricci
(74) *Attorney, Agent, or Firm* — Laabs Intellectual Property

(57) ABSTRACT

In some embodiments, an archery bow comprises a riser, limbs and a bowstring extending between the limbs. A string stop is supported by the riser. The string stop comprises a first body member, a flexion member supported by the first body member and a bumper supported by the flexion member. At least a portion of the flexion member is oriented nonparallel to a shooting axis defined by the archery bow.

20 Claims, 7 Drawing Sheets

(56) References Cited

U.S. PATENT DOCUMENTS

| | | | | |
|---|---|---|---|---|
| 6,745,757 | B2 | 6/2004 | Sims | |
| 6,802,307 | B2 | 10/2004 | Leven | |
| D593,181 | S | 5/2009 | Barnard | |
| 7,721,724 | B2 | 5/2010 | Goade | |
| 7,753,044 | B2 | 7/2010 | Goade | |
| 7,793,646 | B2 | 7/2010 | Cooper et al. | |
| 7,954,481 | B2 | 6/2011 | Barnard | |
| 8,020,544 | B2 | 9/2011 | McPherson et al. | |
| 8,276,576 | B1 * | 10/2012 | Kuhn | F41B 5/1426 124/89 |
| 8,408,195 | B2 | 4/2013 | McPherson | |
| 8,616,189 | B2 * | 12/2013 | McPherson | F41B 5/1426 124/88 |
| 8,839,775 | B2 | 9/2014 | Wasilewski et al. | |
| 9,046,317 | B2 | 6/2015 | McPherson | |
| 9,140,515 | B2 * | 9/2015 | Yi | F41B 5/10 |
| 9,291,422 | B1 | 3/2016 | Gold et al. | |
| D776,780 | S | 1/2017 | Barnard | |
| 10,215,521 | B1 * | 2/2019 | Huang | F41B 5/1426 |
| D853,518 | S | 7/2019 | Ozanne | |
| 2006/0180135 | A1 | 8/2006 | Andrews | |
| 2008/0092868 | A1 | 4/2008 | Silverson | |
| 2008/0264400 | A1 | 10/2008 | Wright | |
| 2009/0071458 | A1 | 3/2009 | Gordon et al. | |
| 2009/0133683 | A1 | 5/2009 | Wright | |
| 2011/0011385 | A1 | 1/2011 | Grace, Jr. et al. | |
| 2012/0042861 | A1 | 2/2012 | Anselmo | |
| 2018/0231345 | A1 | 8/2018 | McPherson | |
| 2018/0306550 | A1 | 10/2018 | McPherson et al. | |

* cited by examiner

ARCHERY BOW STRING STOP

CROSS-REFERENCE TO RELATED APPLICATIONS

This application claims the benefit of U.S. Patent Application No. 62/815,970, filed Mar. 8, 2019, the entire content of which is hereby incorporated herein by reference.

BACKGROUND OF THE INVENTION

This invention relates to archery bows and string stops for archery bows. Archery bows are known in the art and often include a string stop arranged to contact the bowstring as an arrow is launched. Prior string stops often include a rigid structural component and a soft string contacting material.

There remains a need for novel string stop designs that provide benefits over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, a string stop comprises a first body member arranged to be supported by an archery bow. A flexion member is supported by the first body member and a bumper is supported by the flexion member. At least a portion of the flexion member is oriented nonparallel to a longitudinal axis of the string stop.

In some embodiments, an archery bow comprises a riser, limbs and a bowstring extending between the limbs. A string stop is supported by the riser. The string stop comprises a first body member, a flexion member supported by the first body member and a bumper supported by the flexion member. At least a portion of the flexion member is oriented nonparallel to a shooting axis defined by the archery bow.

In some embodiments, the flexion member is straight along its length. In some embodiments, the flexion member comprises curvature along its length. In some embodiments, the archery bow comprises a cable that is adjacent to a concave side of the flexion member.

In some embodiments, the flexion member comprises a noncircular shape. In some embodiments, the flexion member comprises a width and a thickness, the width being at least three times the thickness.

In some embodiments, the first body member comprises a different material from the flexion member. In some embodiments, flexion comprises a composite material. In some embodiments, the composite material comprises glass fibers.

In some embodiments, the flexion member is attached to the first body member by a moment connection. In some embodiments, the moment connection comprises a first fastener and a second fastener.

In some embodiments, first body member comprises a surface in contact with the flexion member, the surface oriented nonparallel to the shooting axis.

In some embodiments, the string stop comprises a second body member supported by the flexion member, the bumper supported by the second body member.

In some embodiments, the first body member and the second body member comprise similar shapes.

In some embodiments, the first body member comprises a first post and the second body member comprises a second post. In some embodiments, a central axis of the first post is collinear with a central axis of the second post. In some embodiments, a central axis of the first post is parallel to and offset from a central axis of the second post.

In some embodiments, the second body member comprises a surface in contact with the flexion member, the surface oriented nonparallel to the shooting axis.

In some embodiments, the string stop comprises a second flexion member supported by the first body member. In some embodiments, the second flexion member is arranged to support the bumper. In some embodiments, the first flexion member and the second flexion member comprise similar shapes and have opposite orientations.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
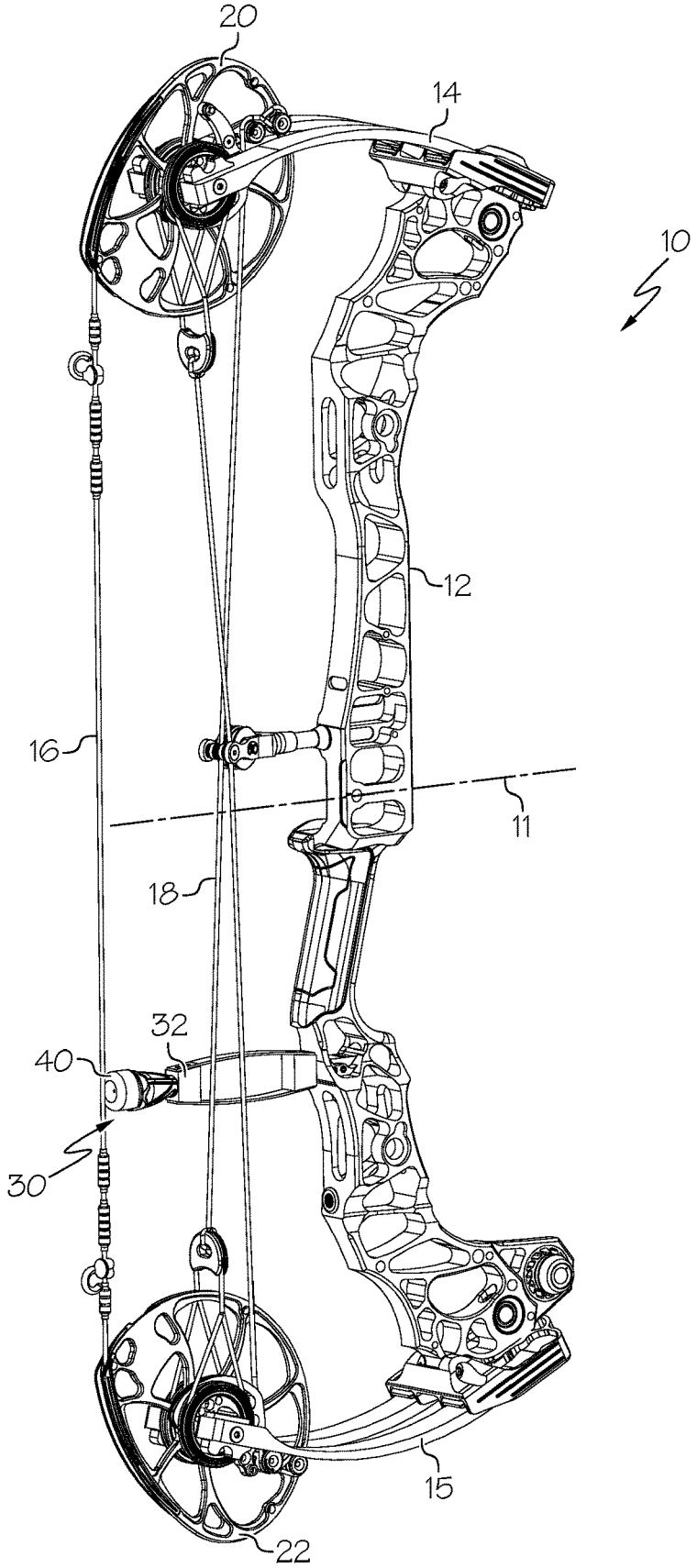
FIG. 1 shows an embodiment of an archery bow with an embodiment of a string stop.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. Desirably, a bow 10 comprises a riser 12 and limbs 14, 15. Desirably, the bow 10 defines a shooting axis 11. A bowstring 16 extends between the limbs 14. In some embodiments, a bow 10 comprises a compound bow comprising rotatable members 20, 22 and at least one power cable 18. In some embodiments, the bowstring 16 extends between the rotatable members 20, 22.

In some embodiments, a bow 10 comprises a string stop 30. In some embodiments, the string stop 30 is arranged to contact the bowstring 16 during and/or after an arrow launch. In some embodiments, the string stop 30 contacts the bowstring 16 when the bow 10 is in the brace condition as shown in FIG. 1. In some embodiments, the string stop 30 is spaced apart from the bowstring 16 when the bow 10 is in the brace condition.

In some embodiments, a string stop 30 is attached to the riser 12, although a string stop 30 can be supported by any suitable part of the bow 10. In some embodiments, a riser 12 comprises an aperture arranged to receive the string stop 30.

Figure 2:
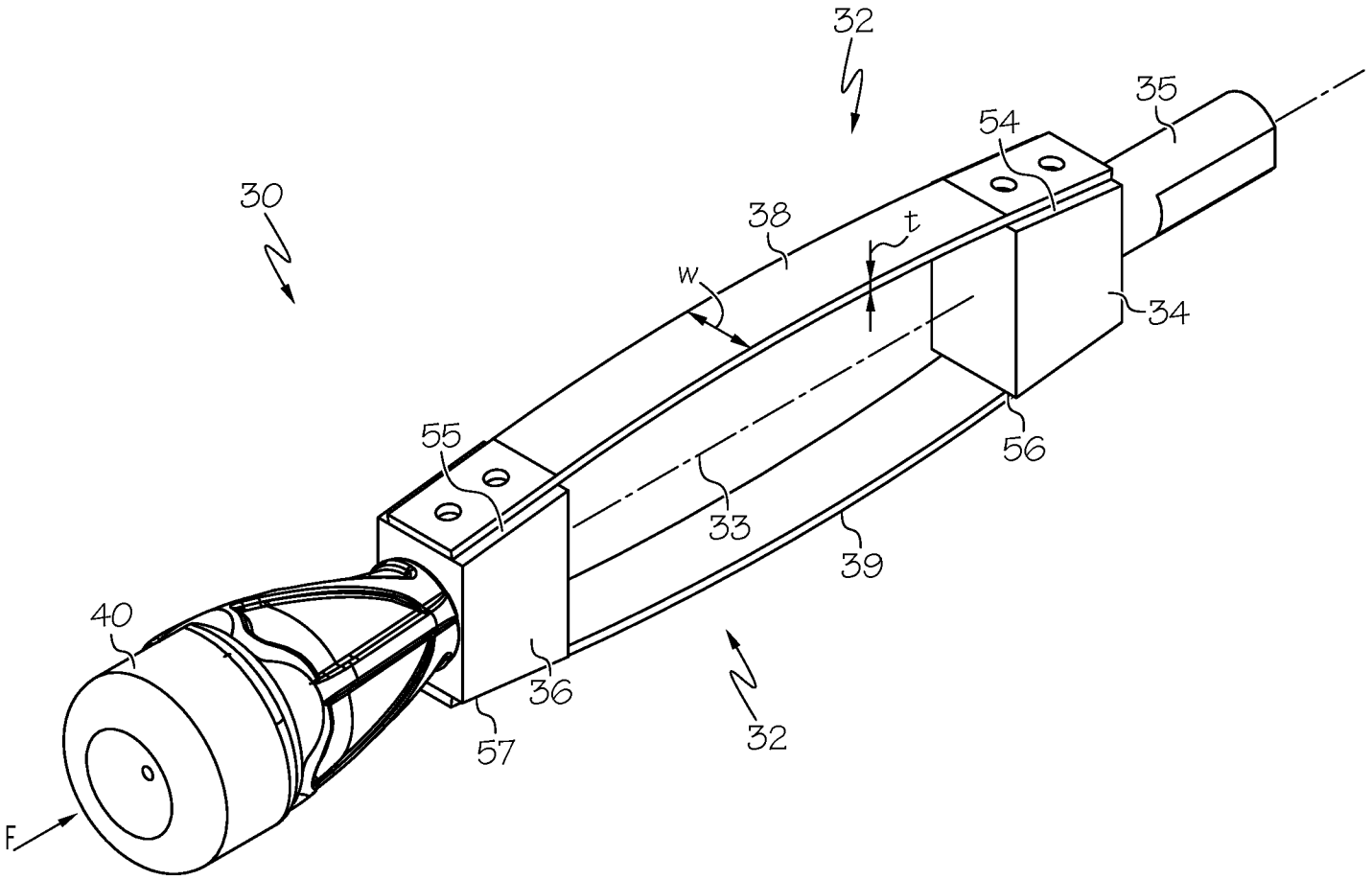
FIG. 2 shows the string stop of FIG. 1 in greater detail.
Figure 3:
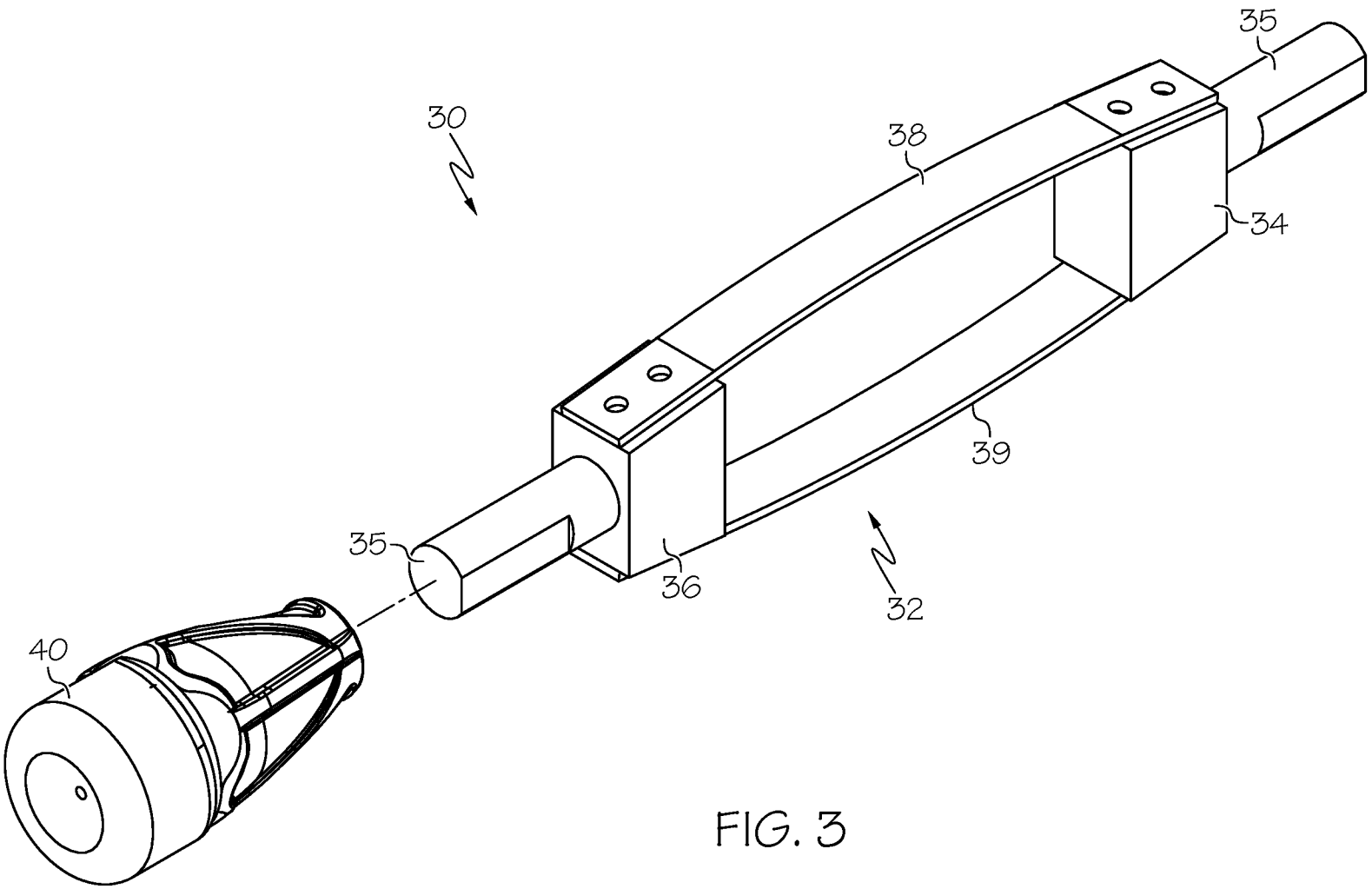
FIG. 3 shows the string stop of FIG. 2 with the bumper removed.

FIGS. 2 and 3 show an embodiment of a string stop 30. In some embodiments, a string stop 30 comprises a body 32 and a bumper 40. In some embodiments, the body 32 comprises one or more materials that are different from a material used to form the bumper 40. For example, in some embodiments, a bumper 40 comprises rubber, an elastomer or other soft material having a relatively high level of elastic deformability. In some embodiments, the body 32 comprises one or more materials that are non-elastomeric or other hard materials having a higher level of rigidity than the bumper 40.

In some embodiments, the body 32 comprises a first body member 34 arranged to be supported by the archery bow 10. In some embodiments, the body 32 comprises a flexion member 38 that is supported by the first body member 34. In some embodiments, the bumper 40 is supported by the flexion member 38. In some embodiments, the body 32 further comprises a second body member 36. In some embodiments, the second body member 36 is supported by the flexion member 38 and the second body member 36 supports the bumper 40. In some embodiments, the first body member 34 is spaced apart from the second body member 36 and does not contact the second body member 36.

In some embodiments, at least a portion of the flexion member 38 is oriented nonparallel to the shooting axis 11. In some embodiments, at least a portion of a longitudinal axis of the flexion member 38 is oriented nonparallel to the shooting axis 11.

In some embodiments, the flexion member 38 comprises a material that is different from a body member 34, 36. In some embodiments, the body member(s) 34, 36 comprise a metal, such as aluminum. In some embodiments, a flexion member 38 comprises a non-metal. In some embodiments, a flexion member 38 comprises a composite material such as materials used to form archery bow limbs. In some embodiments, a flexion member 38 comprises a polymer and/or a resin reinforced with fibers such as glass fibers, carbon fibers, etc.

In some embodiments, the body 32 comprises a second flexion member 39. In some embodiments, the flexion members 38, 39 are mirrored across a central axis 33 of the body 32.

In some embodiments, the flexion member(s) 38, 39 comprise curvature. The embodiment of a body 32 shown in FIG. 2 allows the flexion members 38, 39 of the body 32 to receive and damp forces (e.g. F) applied to the bumper 40.

In some embodiments, the flexion member(s) 38, 39 are preloaded in bending along their length. In some embodiments, the flexion member(s) 38, 39 are preloaded with equal but opposite forces. In some embodiments, the first body member 34 comprises a first abutting surface 54 arranged to contact the first flexion member 38 and a second abutting surface 56 arranged to contact the second flexion member 39. In some embodiments, at least a portion of the first abutting surface 54 is oriented at an angle to the central axis 33. In some embodiments, at least a portion of the second abutting surface 56 is oriented at an angle to the central axis 33. In some embodiments, the first abutting surface 54 and the second abutting surface 56 are oriented at equal but opposite angles to the central axis 33.

In some embodiments, second body member 36 comprises a first abutting surface 55 arranged to contact the first flexion member 38 and a second abutting surface 57 arranged to contact the second flexion member 39. In some embodiments, at least a portion of the first abutting surface 55 is oriented at an angle to the central axis 33. In some embodiments, at least a portion of the first abutting surface 55 is oriented at an angle to the shooting axis 11. In some embodiments, at least a portion of the second abutting surface 57 is oriented at an angle to the central axis 33. In some embodiments, the first abutting surface 55 and the second abutting surface 57 are oriented at equal but opposite angles to the central axis 33.

In some embodiments, the flexion member(s) 38, 39 are attached to the body member(s) 34, 36 using any suitable method, such as adhesive, fasteners, etc.

In some embodiments, the first body member 34 and the second body member 36 have similar shapes with different orientations. In some embodiments, a body member 34, 36 comprises a post 35. In some embodiments, a post 35 of the first body member 34 is arranged to be supported by a bow 10, for example arranged to be received in an aperture in the riser 12. In some embodiments, a post 35 of the second body member 36 is arranged to support the bumper 40.

A flexion member 38 can have any suitable size and shape. A flexion member 38 can comprise any suitable material. The flexion member(s) 38, 39 can be configured to have any suitable strength characteristics to provide various levels of deformation and damping under use.

In some embodiments, a flexion member 38 comprises a noncircular cross-sectional shape. In some embodiments, a flexion member 38 comprises a substantially rectangular cross-sectional shape. In some embodiments, a flexion member 38 comprises a width w and a thickness t. In some embodiments, the width w is at least three times the thickness t.

Figure 4:
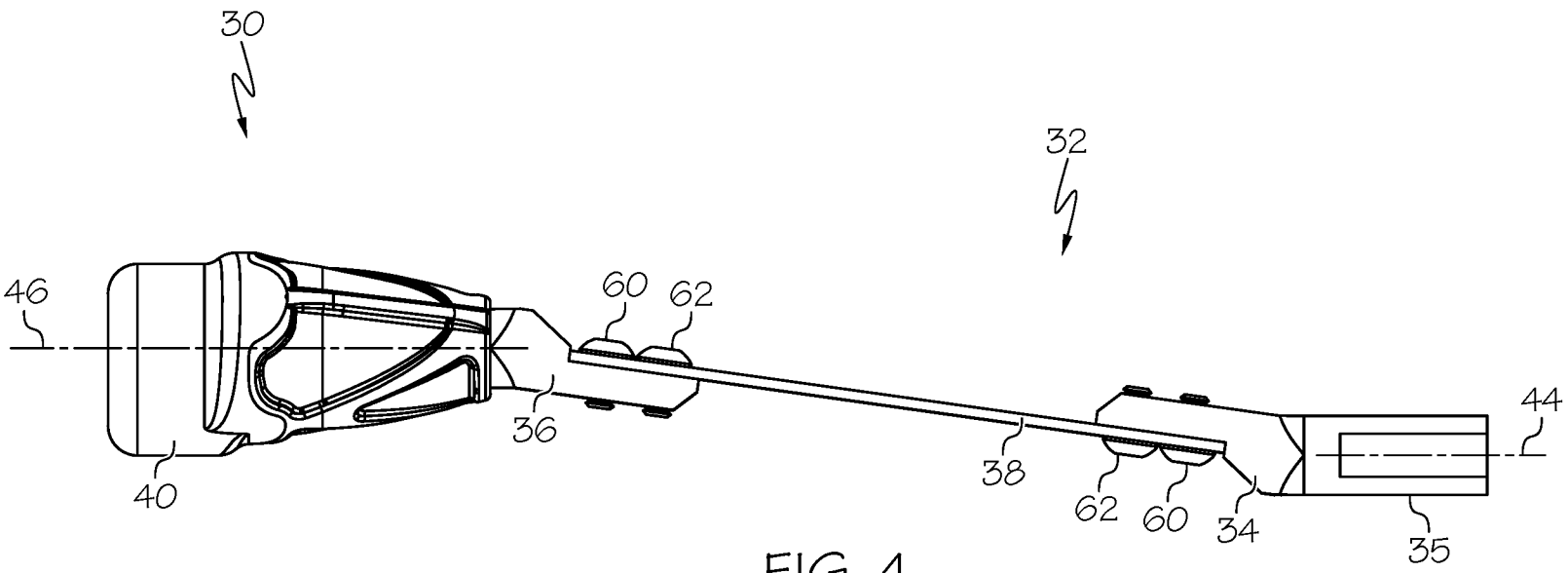
FIG. 4 shows another embodiment of a string stop.
Figure 5:
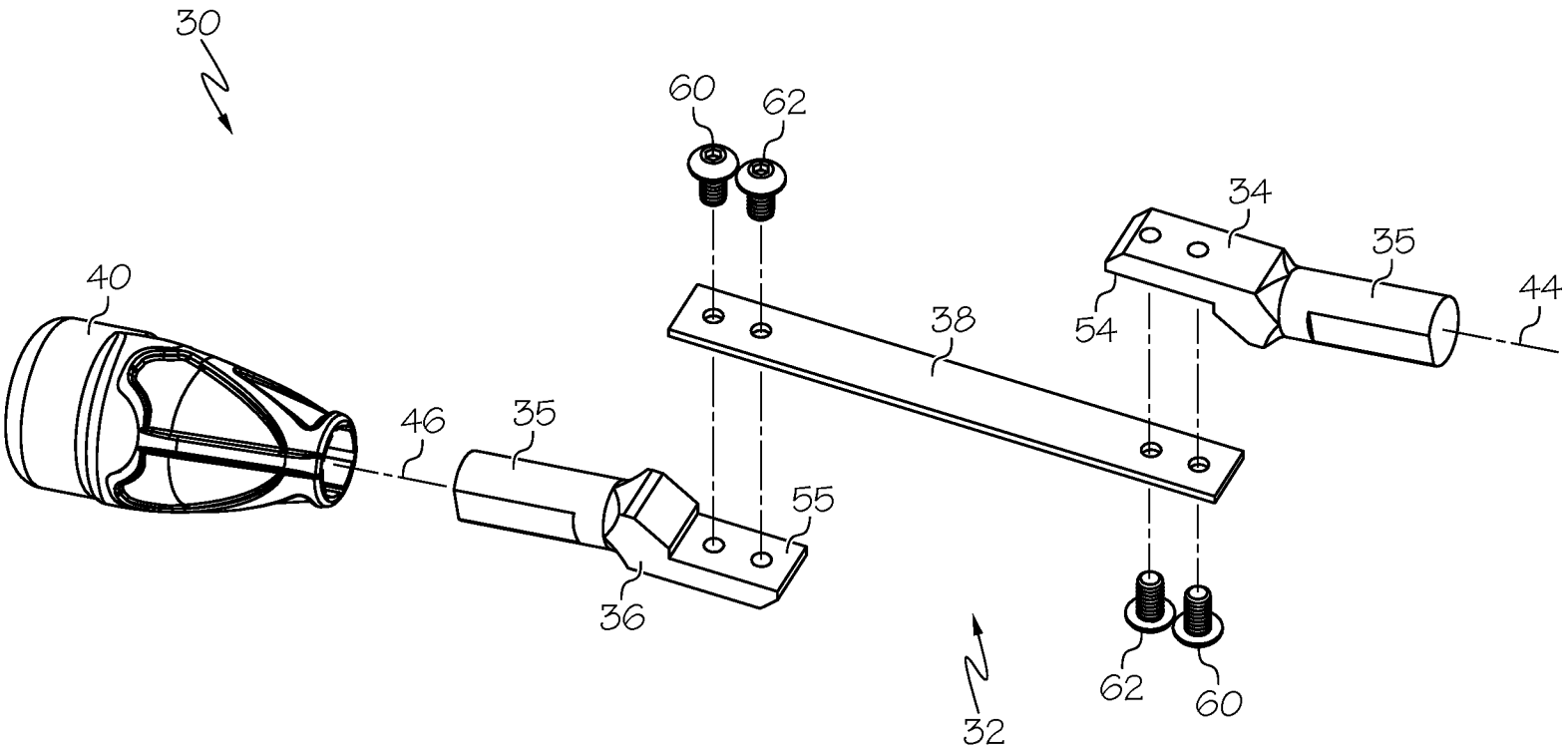
FIG. 5 shows an exploded view of the embodiment of FIG. 4.

FIGS. 4 and 5 show another embodiment of a string stop 30. In some embodiments, a flexion member 38 is arranged to extend at an angle to the shooting axis 11 of the bow 10. In some embodiments, the flexion member 38 is straight along its length.

In some embodiments, an axis 44 of the post 35 of the first body member 34 is arranged parallel to the shooting axis 11 of the bow 10. In some embodiments, an axis 46 of the post 35 of the second body member 36 is arranged parallel to the axis 44 of the post 35 of the first body member 34. In some embodiments, the axis 44 is offset from the axis 46. This arrangement can encourage the bumper 40 to displace in a particular direction (e.g. lateral direction) as the flexion member 38 flexes after an arrow launch. In some embodiments, the configuration of the string stop 30 can encourage the bowstring 16 to consistently rebound in a predetermined direction. In some embodiments, the predetermined direction is nonparallel to the shooting axis 11.

In some embodiments, one or both body members 34, 36 comprise a flat abutting surface 54, 55 arranged to abut a surface of a flexion member 38. In some embodiments, a flat surface 54, 55 is oriented at an angle to the axis 44, 46 defined by an associated post 35.

In some embodiments, a flexion member 38 is attached to a body member 34, 36 by a moment connection. In some embodiments, a moment connection comprises a first fastener 60 and a second fastener 62.

Figure 6:
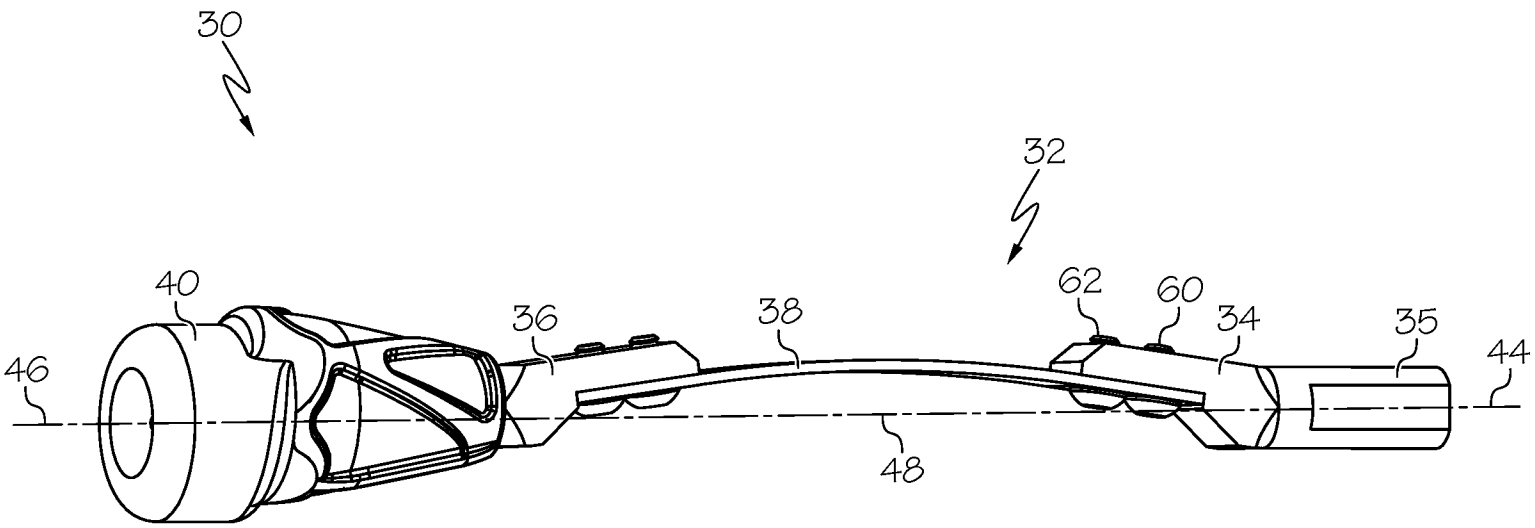
FIG. 6 shows another embodiment of a string stop.

FIG. 6 shows another embodiment of a string stop 30. In some embodiments, posts 35 of the body members 34, 36 are aligned on a common axis 48 and are collinear. In some embodiments, a flexion member 38 comprises curvature along its length and is offset from the axis 48.

Figure 7:
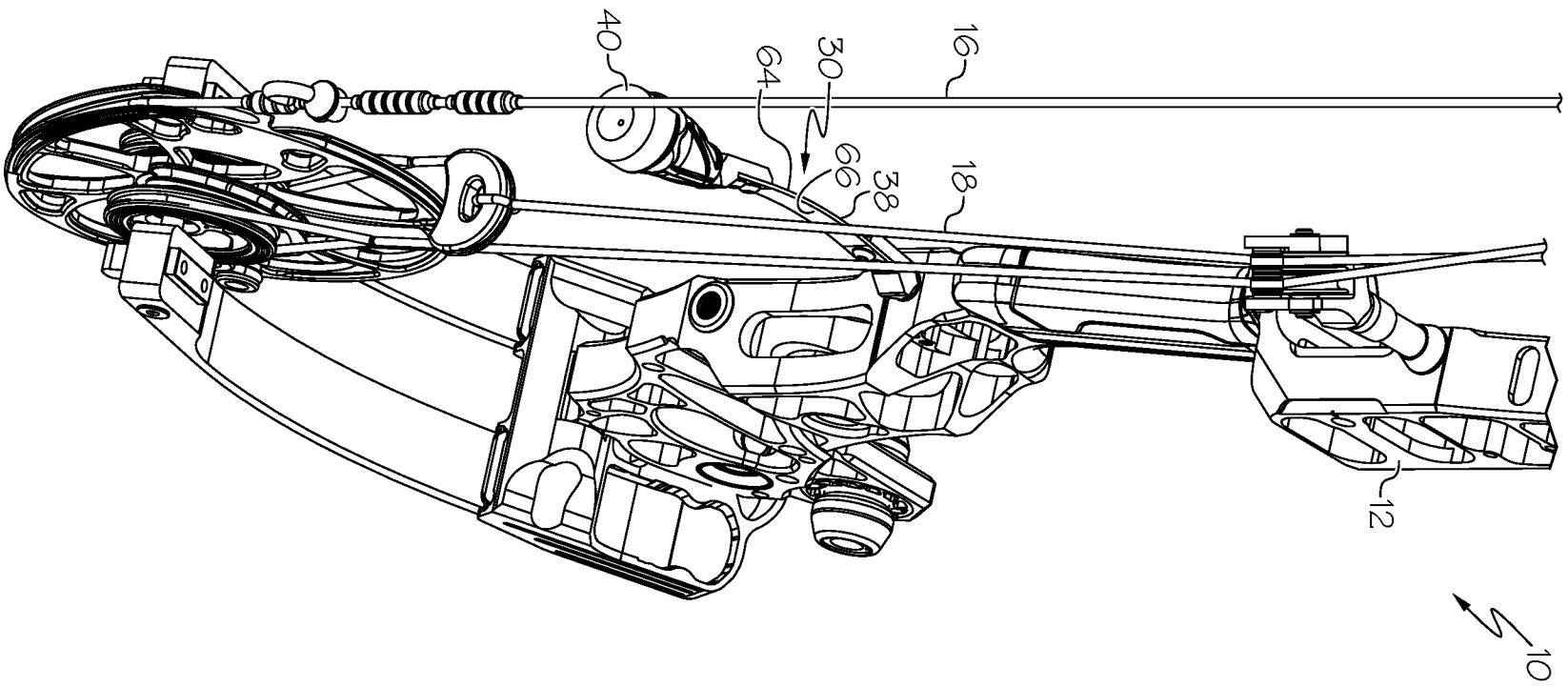
FIG. 7 shows the string stop of FIG. 6 on a bow.

FIG. 7 shows the embodiment of a string stop 30 shown in FIG. 6 installed on an embodiment of a bow 10. In some embodiments, curvature in the flexion member 38 provides clearance for cabling (e.g. 18) of the bow 10. In some embodiments, a flexion member 38 comprises a convex side 64 and a concave side 66. In some embodiments, one or more cables 18 of the archery bow 10 are adjacent to the concave side 66. In some embodiments, the concave side 66 defines a cavity space and a cable 18 is oriented in the cavity space.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser, limbs and a bowstring extending between the limbs; and a string stop comprising a first body member supported by the riser, a flexion member supported by the first body member and a bumper supported by the flexion member, at least a portion of the flexion member oriented nonparallel to a shooting axis defined by the archery bow, the first body member comprising a different material from the flexion member, the flexion member comprising a composite material.

2. The archery bow of claim 1, wherein the flexion member is straight along its length.

3. The archery bow of claim 1, the flexion member comprising curvature along its length.

4. The archery bow of claim 3, the flexion member comprising a convex side and a concave side, the archery bow comprising a cable adjacent to the concave side.

5. The archery bow of claim 1, the composite material comprising glass fibers.

6. The archery bow of claim 1, the flexion member attached to the first body member by a moment connection.

7. The archery bow of claim 6, the moment connection comprising a first fastener and a second fastener.

8. The archery bow of claim 1, the string stop comprising a second body member supported by the flexion member, the bumper supported by the second body member.

9. The archery bow of claim 8, the first body member and the second body member comprising similar shapes.

10. The archery bow of claim 8, the first body member comprising a first post, the second body member comprising a second post.

11. The archery bow of claim 10, wherein a central axis of the first post is collinear with a central axis of the second post.

12. The archery bow of claim 10, wherein a central axis of the first post is parallel to and offset from a central axis of the second post.

13. The archery bow of claim 8, the second body member comprising a surface in contact with the flexion member, the surface oriented nonparallel to the shooting axis.

14. The archery bow of claim 1, the flexion member comprising a first flexion member, the string stop comprising a second flexion member supported by the first body member.

15. The archery bow of claim 14, the second flexion member arranged to support the bumper.

16. The archery bow of claim 15, wherein the first flexion member and the second flexion member comprise similar shapes and have opposite orientations.

17. An archery bow comprising:

a riser, limbs and a bowstring extending between the limbs; and a string stop comprising a first body member supported by the riser, a flexion member supported by the first body member and a bumper supported by the flexion member, at least a portion of the flexion member oriented nonparallel to a shooting axis defined by the archery bow;

the flexion member comprising a width and a thickness, the width being at least three times the thickness.

18. The archery bow of claim 17, wherein the first body member comprises a different material from the flexion member.

19. The archery bow of claim 18, the flexion member comprising a composite material.

20. An archery bow comprising:

a riser, limbs and a bowstring extending between the limbs; and a string stop comprising a first body member supported by the riser, a flexion member supported by the first body member and a bumper supported by the flexion member, at least a portion of the flexion member oriented nonparallel to a shooting axis defined by the archery bow;

first body member comprising a surface in contact with the flexion member, the surface oriented nonparallel to the shooting axis.

* * * * *